US008292069B2

(12) United States Patent
Silva Rubio et al.

(10) Patent No.: US 8,292,069 B2
(45) Date of Patent: Oct. 23, 2012

(54) OFFICE SUPPLY CASE

(76) Inventors: Miguel Angel Silva Rubio, Naucalpan (MX); Mauricio Enrique Ferrusca Ceja, Mexico City (MX)

( * ) Notice: Subject to any disclaimer, the term of this patent is extended or adjusted under 35 U.S.C. 154(b) by 0 days.

(21) Appl. No.: 12/495,053

(22) Filed: Jun. 30, 2009

(65) Prior Publication Data

US 2010/0288655 A1 Nov. 18, 2010

(30) Foreign Application Priority Data

May 14, 2009 (MX) ..... MX/u/2009/000157 U

(51) Int. Cl.
*A45C 11/34* (2006.01)

(52) U.S. Cl. ..... 206/214; 206/224; 206/371; 220/836

(58) Field of Classification Search ..... 206/214, 206/224, 575, 1.7, 371, 443, 829, 77.1, 806; 220/837, 847, 770, 771, 772, 836; 16/225, 16/231, 254, 271, 272, 382, 226, 227, DIG. 13, 16/DIG. 43

See application file for complete search history.

(56) References Cited

U.S. PATENT DOCUMENTS 2,678,833 A * 5/1954 Loeb ..... 281/44
3,324,994 A * 6/1967 Rauser ..... 206/8
4,216,862 A * 8/1980 Daenen ..... 206/541
4,445,868 A * 5/1984 Nuttal et al. ..... 434/88
4,611,716 A * 9/1986 Sorlien ..... 206/581
4,836,783 A * 6/1989 Harper ..... 434/87
5,000,327 A * 3/1991 Kincheloe ..... 211/88.01
5,048,715 A * 9/1991 Wolff ..... 220/832
5,174,607 A * 12/1992 Hill ..... 281/45
D333,843 S * 3/1993 Hartmann et al. ..... D19/78
5,213,504 A * 5/1993 Lee et al. ..... 434/84
5,427,265 A * 6/1995 Cautereels et al. ..... 220/318
5,595,300 A * 1/1997 Paik et al. ..... 206/449
6,164,976 A * 12/2000 Wilson ..... 434/414
6,237,767 B1 * 5/2001 Lee ..... 206/373
6,751,878 B2 * 6/2004 Hamann ..... 33/18.3
6,868,967 B2 * 3/2005 Lam ..... 206/350
6,916,179 B2 * 7/2005 Thornton ..... 434/85
2003/0168451 A1 * 9/2003 Bohrer ..... 220/4.22

* cited by examiner

*Primary Examiner* — Jacob K Ackun
*Assistant Examiner* — Jenine Pagan

(57) ABSTRACT

The present invention is a case for the organization, storage, and transportation of a wide variety of writing materials, that includes means for temporarily fixing and supporting said case on a smooth surface such as a wall, a table or such in a way that the writing instruments are found to be perfectly located for the user during a work session and that the case can be removed from said surface for its storage and transportation.

1 Claim, 15 Drawing Sheets

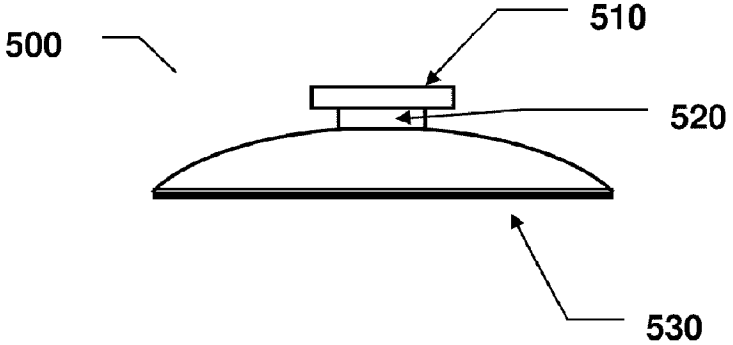
Figura 13
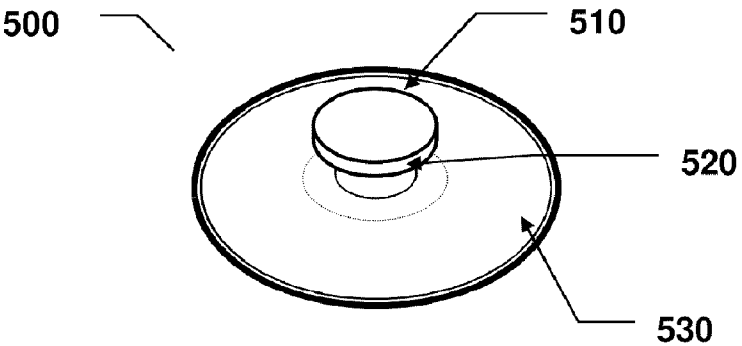
FIGURE 14

OFFICE SUPPLY CASE

CLAIM OF PRIORITY

This application claims priority from Mexican patent application MX/u/2009/000157, "Estuche Para Articulos de Papeleria" filed May 14, 2008.

TECHNICAL FIELD

The present invention refers to a case allowing a plurality of writing instruments to be stored and carried. This case is provided with the necessary means to temporarily secure it to a surface and keep it handy, and it is also provided with fastening means to keep the writing instruments inside.

BACKGROUND OF THE INVENTION

It is known that due to the nature of writing instruments, such as pens, markers, crayons, pencils and permanent markers and especially when there are a lot of them, for use in the graphic arts or just to draw as a hobby, it is necessary to keep them together and organized to allow the user easy access to them.

A simple solution for the previous situation is the usage of a case that is provided with fastening means for each writing instrument, allowing a perfect organization according to the user's needs. There are a lot of types of cases like this. Some examples are as follows:

The U.S. Pat. No. 4,815,622 (Cramer, 1989) describes a sectional container which has at least one front section and one rear section coupling together to form a closed package; the back wall of the front section is used to close the front of the rear section and vice versa. As an option, this sectional container can have one or more intermediate sections that match to the rear section or between the front and rear section to enlarge the container's capacity; the intermediate sections are identical and interchangeable. This alternative offers several advantages due to its modularity and coupling between pieces, however these advantages make the whole container voluminous and produces the problem of organizing the intermediate pieces when decoupled to have access to writing material.

The alternative in U.S. Pat. No. D315,446 (Dietterich et al, 1991) partially solves the difficulties of the previously mentioned container, because it describes a box to keep markers, where they are set in several supports arranged in a parallel arrangement located in the box's body, which has a transparent lid that opens and closes when it turns on a hinge, and the container is installed directly onto a wall by means of screws; with that, it is guaranteed that the material will be organized and always handy; however it seems that the installation on the wall by screws is durable and when user requires to transport the material, this operation will require the usage of special tools (screwdrivers) in order to separate the box from the wall.

On the contrary, the U.S. Pat. No. D390,357 (Rosen, 1998) shows a portable case made with a transparent material which has a hinged lid, that allows portability and easy handling of the whole case and its contents, but it is the user's responsibility to know the location of the case in every moment to avoid its loss.

Similar to the previous, the U.S. Pat. No. D392,463 (Grey, 1998) offers a container with areas designated for storage and possible retention of writing instruments. That container has two sections, front and rear, joined by hinges along one of their edges. It is also provided with the means for closing between both sections, as well as a handle for its transportation. On the other hand, the U.S. Pat. No. 6,680,933 (Demisien et al, 2004) describes a container that offers the same advantages and disadvantages as the one described before, with some changes in the way the writing instruments are held in place in its interior, associated to the shape of the walls of the container; additionally this design includes the means to hang the container when it is closed.

Finally, two alternatives for the usage of the lid of the container for writing instrument from the ones considered here, are shown on U.S. Pat. No. 6,913,143 (Yang, 2005) and the design patent U.S. Pat. No. D538,032S (Rosen et al, 2007). The first one offers a container in which the lid can be detached, because in a different way from the hinged joint of the previous models, in which said joint is formed by the same material as the sections to be joined, in this case the assembly is done by using pivots (threaded screws) that join the front section (lid) and the rear section of the container in two collinear points; the separation of the lid can be achieved by taking out the pivots. In Rosen's design, the lid, which is hinged to the container's body in a similar manner as Yang's patent, can be pivoted in order to provide a support for the entire container. However, in both cases the possibility of the pieces getting loose is still present or, at least, there is a risk of contents of the case can get out if the container is thrown by accident.

SUMMARY OF THE INVENTION

Considering the limitations in the different alternatives developed until now and as described before, an objective of the present invention is to provide a case that allows the user to keep several writing instruments simultaneously, and said case offers the means to enable its temporary fixation, on a location determined by the user, while its content is used.

Another object of the present invention is to provide a case that allows the transportation of many office supplies, organized on its interior.

Another object of this invention is to provide a container that permits easy access, including the insertion and withdrawal from it, of the different writing instruments in its interior.

Another object of this invention is to provide a case that can be easily set up in within the user's working area.

A further object of this invention is to offer a case that can be attached in an easy-to-remove way within the user's working area.

These and other object and advantages of the present invention will become evident during the description that follows, which is accompanied by a group of figures for the preferred embodiments of the invention, that are included just for illustrative purposes and are not to be considered as limiting to the invention.

BRIEF DESCRIPTION OF THE INVENTION

The present invention refers to a case useful for the conservation and transportation of several writing instruments, and it is also convenient to keep writing articles handy or to transport them when and where the user needs, it also includes means to enable its easy-to-remove installation within the user's working area allowing easy and quick access to the writing instruments, and the removal of the case when it is not needed anymore.

The container of this invention includes means for fastening a wide range of writing instruments, said means keep all the instruments secured on its base; providing an easy release of the instruments from the fastening means.

The case body is formed by two sections or parts: a base and a lid, joined by a hinge to allow opening and closure; this container is characterized by a pair of holes located on the walls of the base of the container with dimensions such as to allow the passage and retention in its interior of support means for the case to be set on a flat surface.

The preferred support means are suction cups, that can be installed on any smooth flat surface, such as a wall, a table, or a blackboard, in order to keep the case of this invention in a stable place during the time that user requires the usage of the writing instruments, as well as its easy removal for storage once the usage of the writing instruments is finished.

BRIEF DESCRIPTION OF THE FIGURES

In order to have a better comprehension of the advantages of the system of the invention, a group of figures is included to show the characteristics of some of the preferred embodiments of this case; these embodiments must not be considered as to limit the configuration of the invention.

FIG. 13 is a side view of the preferred means of attachment of this container to a surface, of the type of a conventional suction cup.

FIG. 14 is a simple perspective view of the preferred means of attachment for the container to a surface, of the type of a conventional suction cup.

DETAILED DESCRIPTION OF THIS INVENTION

The following description will be referred to the attached drawings mentioned before, that have to be understood just as a reference for the preferred embodiments of the invention, and not limiting the inventive concept of the invention. The common elements of the figures have the same numeric references in all of them.

The present invention refers to a case used for organizing, storing and transporting a wide variety of writing instruments that includes temporary and removable means for attaching it to a flat surface such as a wall, a table and similar objects, in such way that writing instruments can be perfectly located by the user during a working session.

Figure 1:
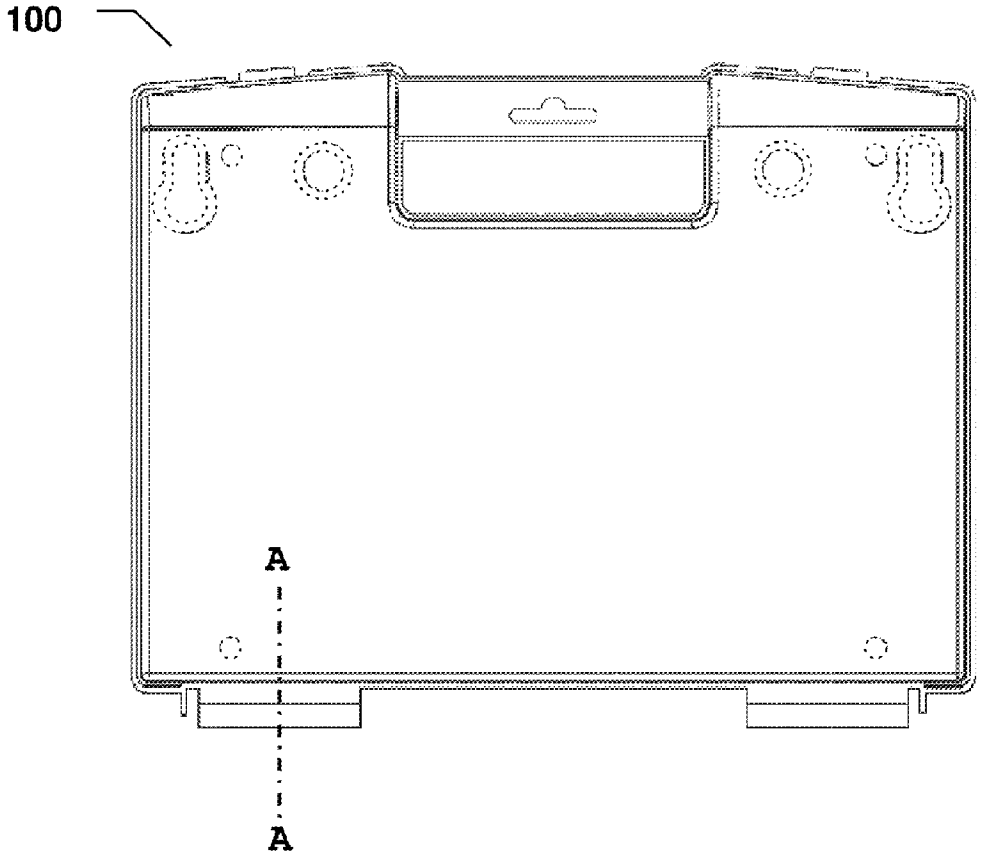
FIG. 1 is a top view, from the lid side, of the case of the invention (it is shown without the means of securing the writing instruments).

This invention case, referred as (100) on FIG. 1 basically is a container consisting of a base section where writing instruments are organized and a lid section (front view in FIG. 1), preferably made of a transparent or translucent material. The base and lid sections are joined by two hinged bodies (110), forming a rectangular-prism shape with rounded corners.

Figure 2:
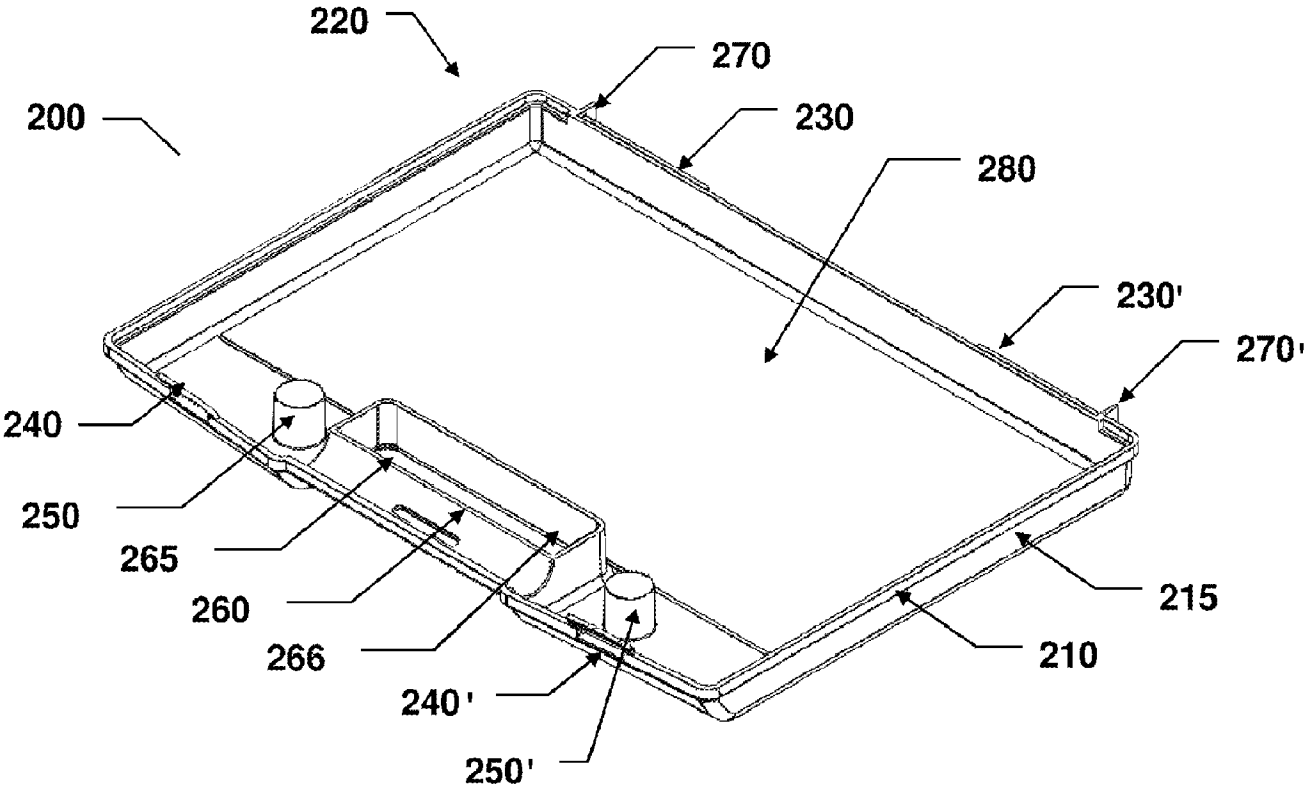
FIG. 2 is a simple perspective view of the interior of the lid of the case of the invention.
Figure 3:
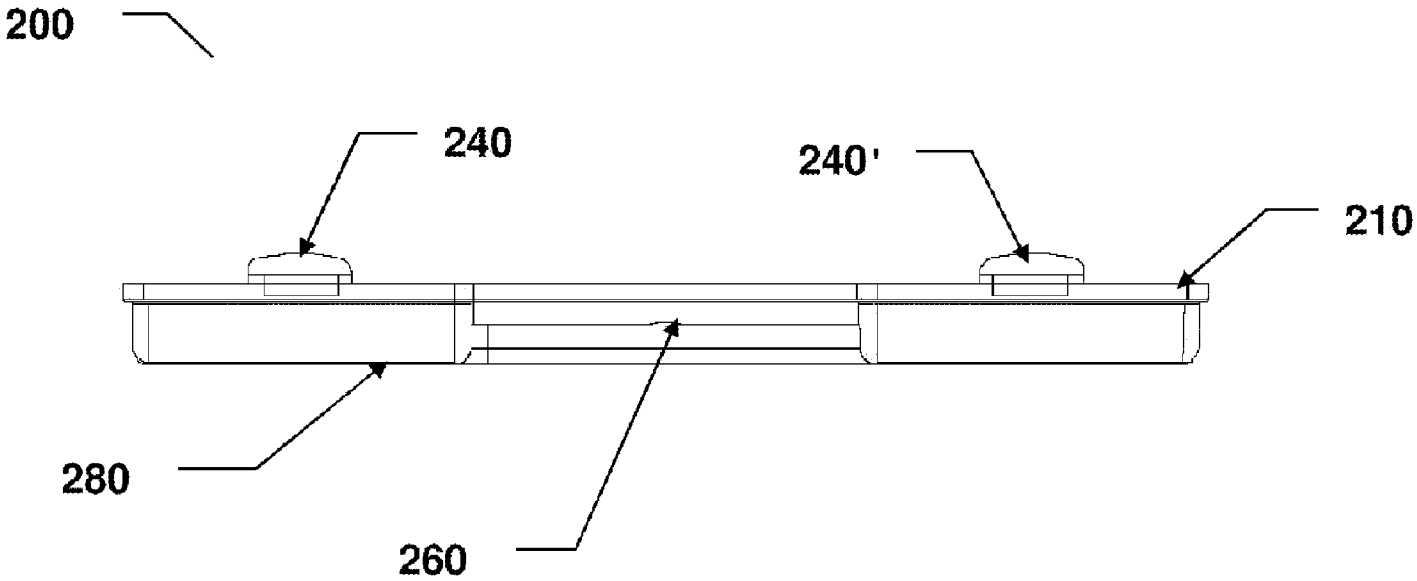
FIG. 3 is a frontal view, from the side that includes the handle, of the lid of the case of the invention.
Figure 4:
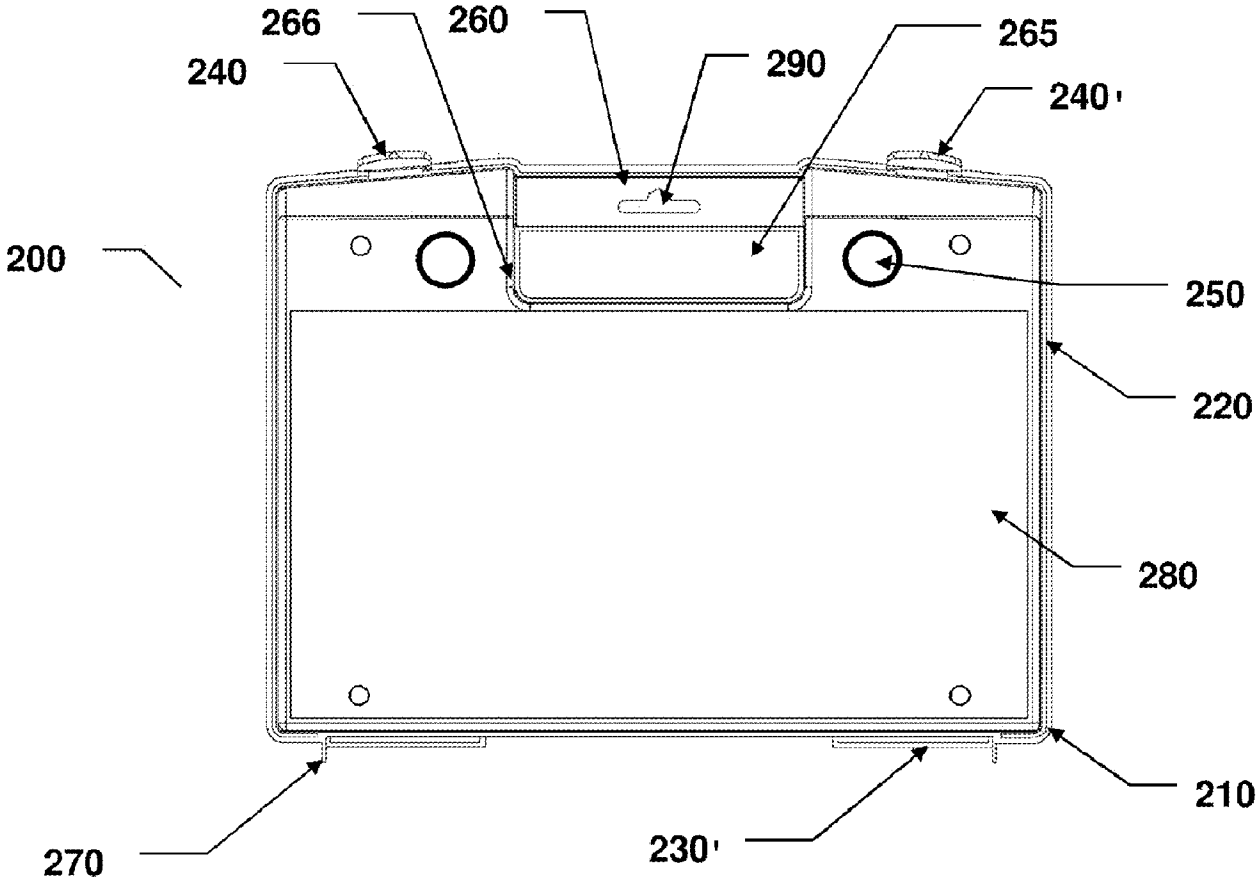
FIG. 4 is a bottom view, of the lid of the case of the invention, showing its interior.
Figure 6:
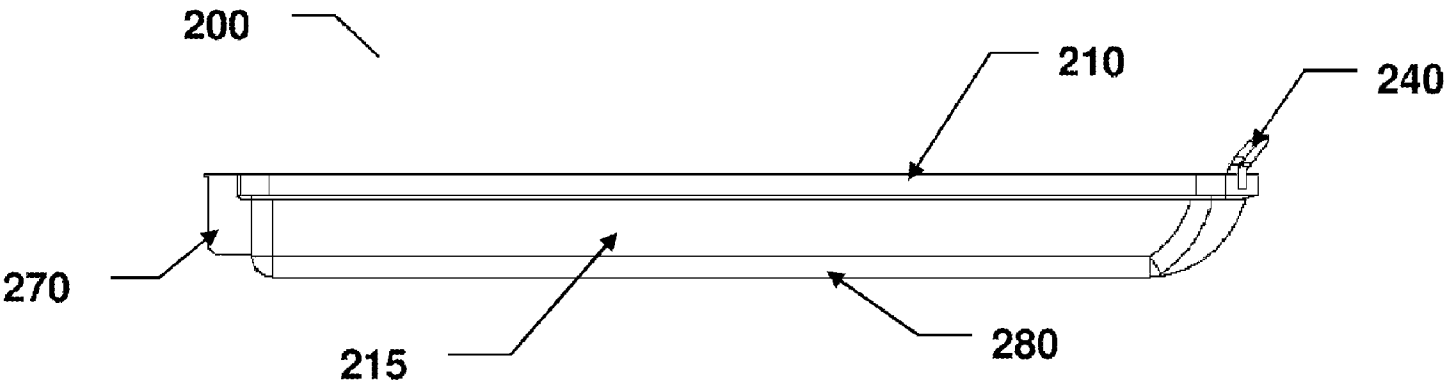
FIG. 6 is a side view of the lid of the case of the invention.

The lid section (200) is shown in FIGS. 2 and 6, and it is formed by several characteristic elements:

i) A cover (280) preferably smooth and made of a transparent or translucent material, with a configuration and dimensions enough to cover the base section (300) (shown on FIG. 7), surrounded by a vertical peripheral wall (215);

ii) A frame (210) to coupling the lid (200) and the outline of the vertical peripheral wall (315) of the base section (300), with a height determined by a lateral rim (220) that rests on the vertical peripheral wall (315) of the base section (300) when the lid and the base are in a closed position; the lateral rim (220) is located all along the interior surface of the vertical peripheral wall (215) of the lid section (200) and it is equidistant to the edge of the frame (210); the frame prevents the access of solid or liquid materials to the case's interior;

iii) A pair of grooves (230), (230') located outside of the base of the lid, that forms the female part of the hinged coupling (110) between the lid section (200) and base section (300), these grooves have a transversal section in a U shape with their ends (231), (232) being closed by a wall of the same material, these grooves (230), (230') are located near the extreme sides of the base side of the lid section (200), in the interior zone that is defined by two projections (270), (270') that function as supports to keep the case (100) in a vertical position when it is closed;

iv) Means for closure (340), (340') between the lid section (200) and the base section (300), that fit on the reception means (240), (240') located in the zone that corresponds to the base section (300);

v) Reinforcement elements (250), (250') to avoid the deformation of the lid section (200), that match with their corresponding elements (350), (350') of the base section (300) to achieve a good fit between both sections;

vi) A handle that consists of two corresponding and complementary sections formed in a comprehensive way on the lid (200) and base (300) sections, referred as (260) and (360) respectively;

vii) A hole (265) to allow the entrance of the user's hand, set up by a bearing wall (266) that match up with their corresponding base section (300); the joints between the bearing wall (266) and the cover of lid section (200) preferably should be rounded;

Additionally, the handle (260)-(360) include a perforation (290) to allow the passage of the exhibition elements used to hang and/or exhibit the case, such as hooks or supports. This allows for the exhibition of the case at the so called point-of-sale.

Figure 5:
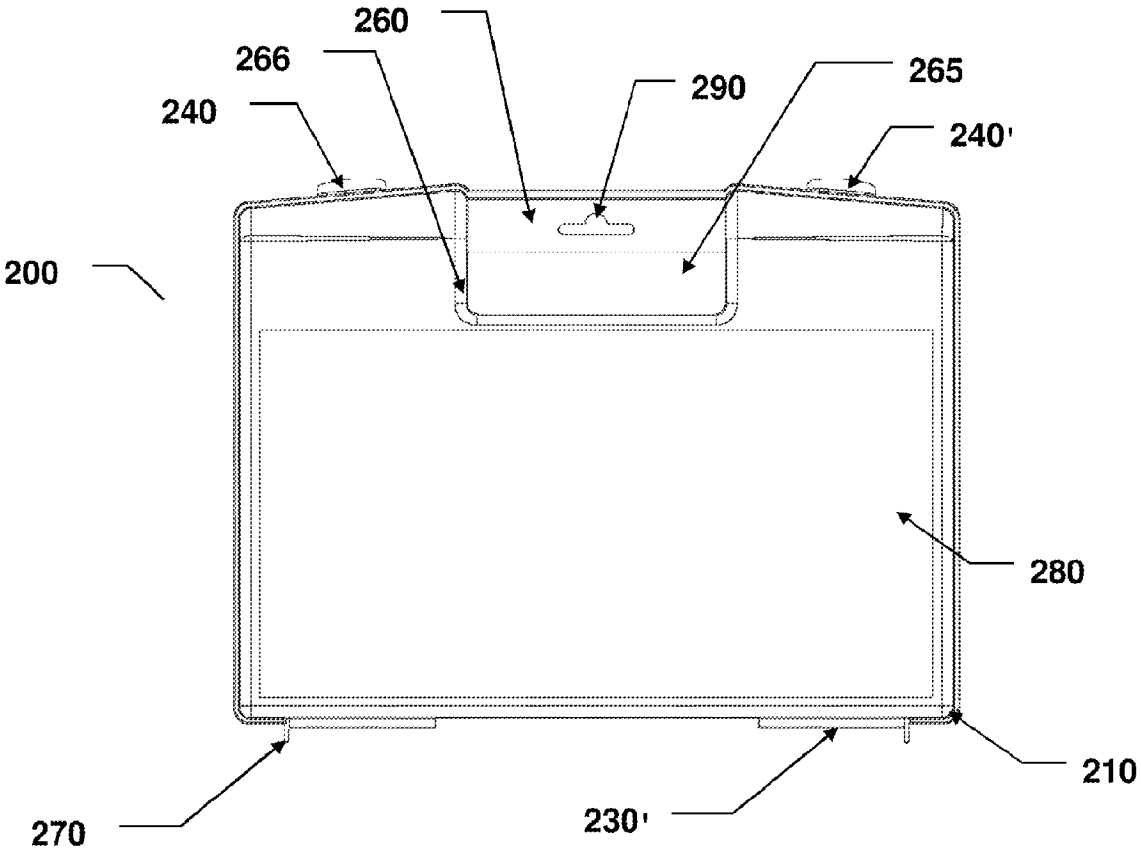
FIG. 5 is a top view of the lid of the case of the invention, showing its exterior.

As can be seen in FIG. 5, the exterior surface of the cover (280) of the section of the lid (200) can be used for the application of publicity, as it is a broad, smooth surface.

Figure 7:
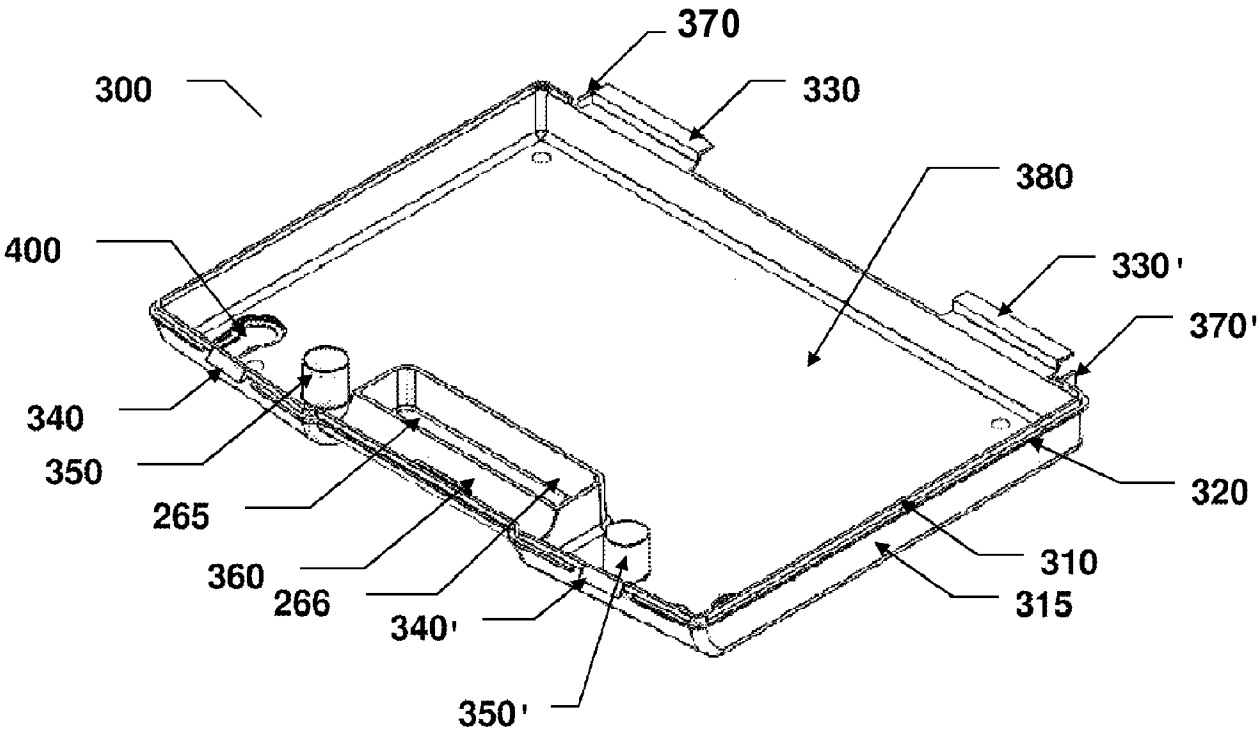
FIG. 7 is a simple perspective view of the interior of the case of the invention. (It is shown without the means of attaching the writing instruments.)
Figure 8B:
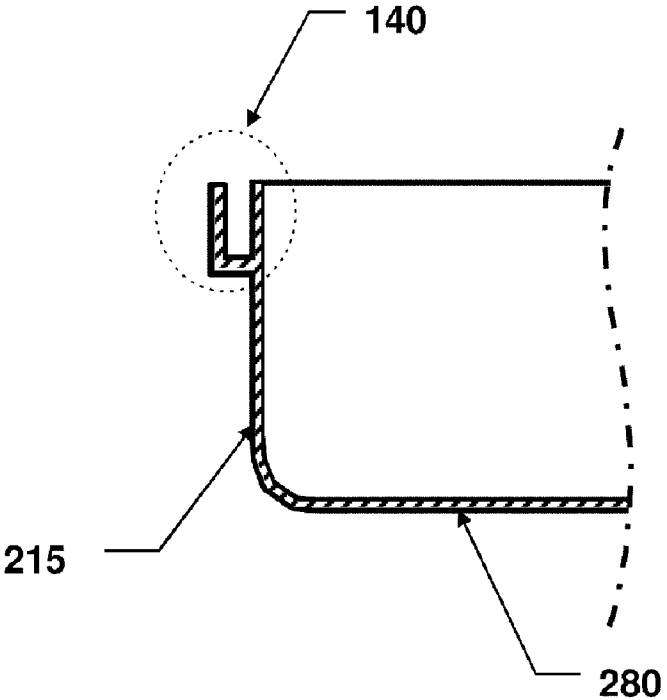
FIG. 8*b* is a partial cross-sectional view showing the details of the joint hinged element of the case of the invention that corresponds to the lid section.
Figure 8A:
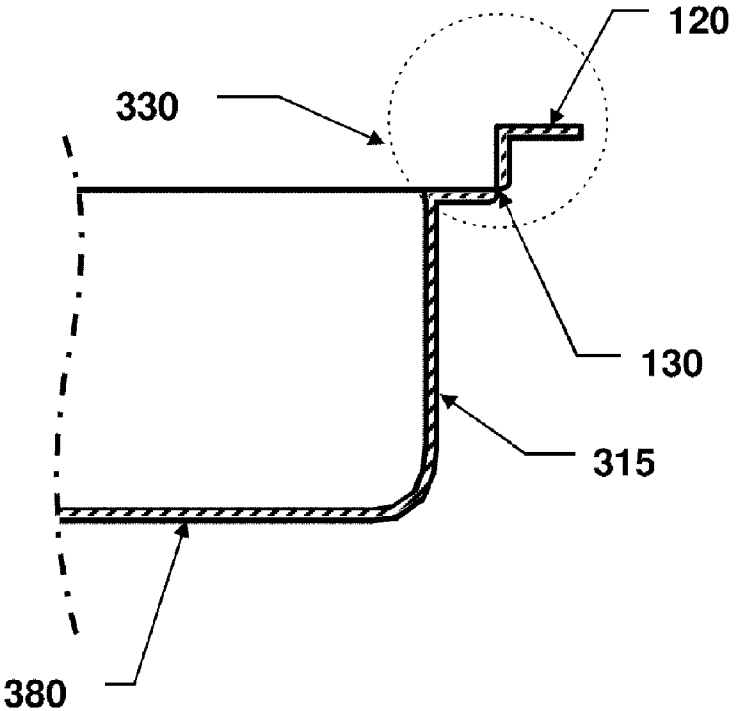
FIG. 8*a* is a partial cross-sectional view showing in detail the joint hinged element of the case of the invention that corresponds to the body section.

The section of the container (300) that is illustrated in perspective view in FIG. 7 shows the coupling elements that form the hinges (330), (330') as well as the closure means (340), (340') that correspond with those in the lid (200) and other characteristic elements that will be described here as follows:

i. A cover (380) with dimensions and interior configuration that includes elements for fasten a multitude of writing utensils adapted to the shape and the quantity of utensils that will contain, ii. A perimeter border (310) to join the section of the container (300) to the outline section of the lid (200), with a lateral perimetral rim (320) where the edge (210) of the section of the lid (200) rests, projecting outwards the exterior wall, iii. A pair of projections (330), (330') that form the male section of the tongue and groove joint of the hinge (110) between the sections of the lid (200) and the base (300), said projections (330), (330') are located in a manner that corresponds to the grooves (230), (230') of lid section (200), in the inferior zone defined by the two projections (370), (370') as a means of support that also corresponds to the projections (270), (270'), iv. Closing means (340), (340') of the lid section (200), to form a co-operable means to the base section (300), made by two projections that fasten to the corresponding elements (240), (240') located in the corresponding zone on the lid section (200), v. Reinforcement elements (350), (350') to avoid the deformation of the section of the container (300) that corresponds to those in the lid sections (200) for the joining of both sections, vi. A handle (360) integrally formed in the body section of the base (300), including a perimetral wall (366) that defines an empty space (365) to allow the passage of the hand of the user, corresponding to that (265) in the section of the lid (200) and where the edges of said wall (366) are designed to coincide with those that correspond to the bearing wall (266) in the lid section (200); the union between the walls (366) and the cover (380) of the section of the base (300) are to preferably be rounded.

As is the case with the section of the lid (200), the handle on the section of the base (300) additionally include a perforation (390) to allow the passage of hanging elements in order to exhibit the case; corresponding with the perforation (290) comparable to those in the section of the lid (200).

The lid (380) has a pair of perforations (400) characteristic of the case (100) of the invention, that have the purpose of securing and maintaining in its interior, means of support (500), (500') to temporarily hold, support or fix the case (100) of the invention to a smooth surface such as a wall, a table, or the board.

These perforations (400) are located close to the upper corners, in the side of the handle, of the base section (300), taking as a reference the case (600) (the lid is not illustrated, for better clarity of the drawing) in a vertical position with the handle upwards; the perforations (400) have the approximate shape of a skinny "8". They have the "lower" section of the hole with dimensions large enough to permit the passage of the body of attachment (510) of the suction cups (500), (500') that represents the preferred means of attachment; the "upper" section of each perforation (400) has a size such that allow for the neck (520) of the suction cups (500), (500') to pass through it and maintain it stable, as is illustrated schematically in FIG. 12, in such a way that the structure of the case (600) can remain "hanging" in an open position on a wall or other smooth vertical surface, and remaining in place sustained by the effect of the suction between the cups and said surface.

As has been indicated above, the preferred embodiment for the means of support of the article of the invention are conventional suction cups, such as those that are schematically illustrated in FIGS. 13 and 14, referred to by the numbers (500), (500'); these suction cups (500), (500') are composed of the body of the cup (530), and the body of attachment (510) united by the neck (520), formed all from the same material, usually flexible plastic.

Figure 12:
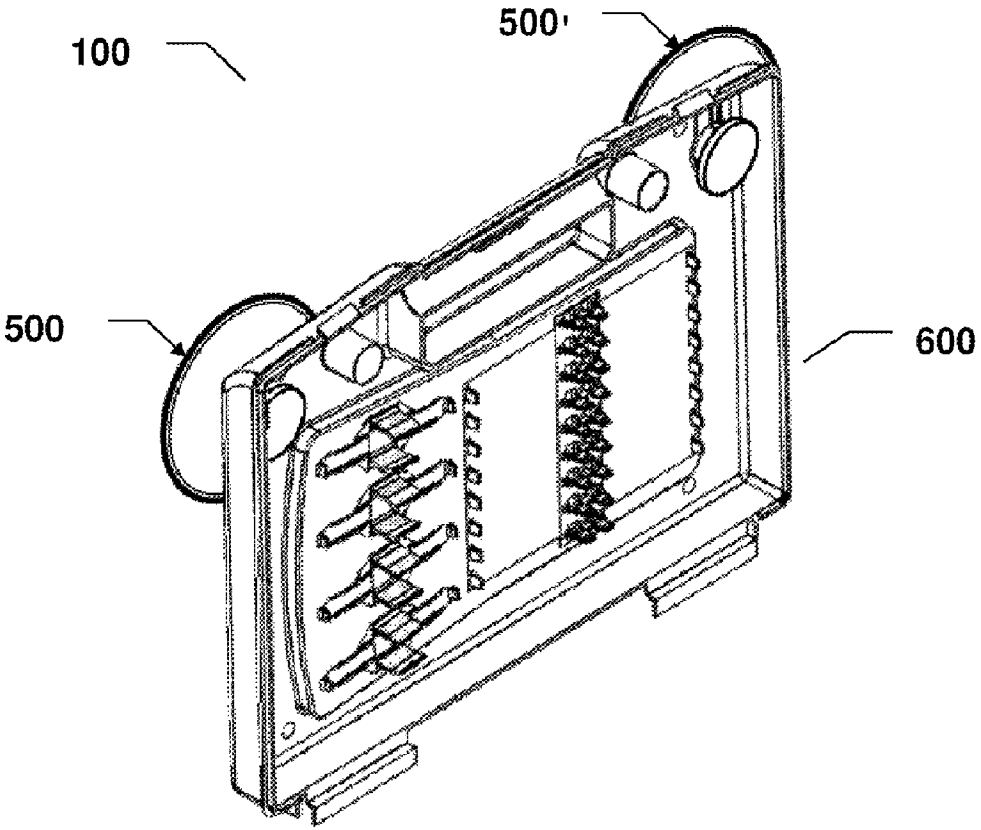
FIG. 12 is a simple perspective view of the body of the case of the invention for a first embodiment of the means of attaching the writing instruments, and with the attaching means for the case of the invention to a surface in a working position.
Figure 15:
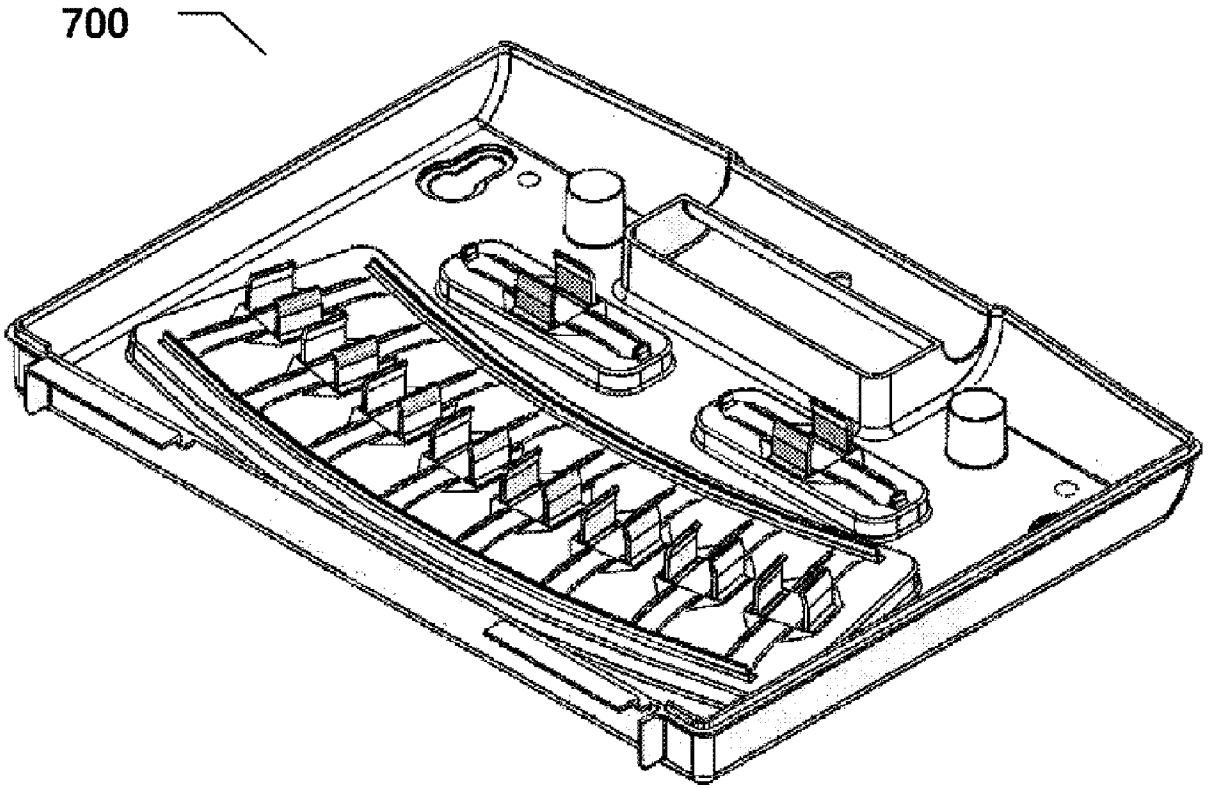
FIG. 15 is a simple perspective view of the interior of the body of the invented case of the invention for a second embodiment of the means for attaching the writing instruments.
Figure 16:
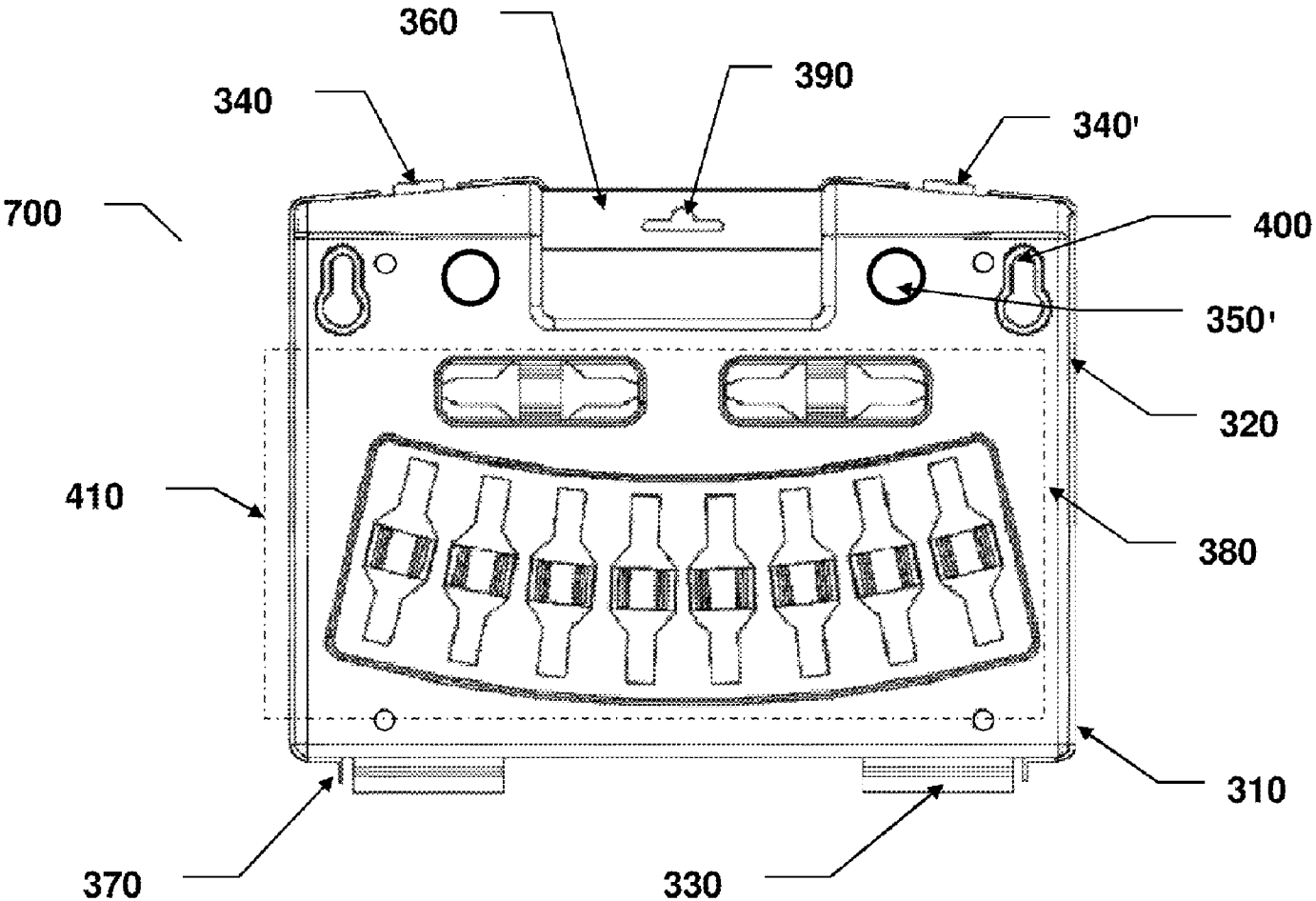
FIG. 16 is a top view of the interior of the body of the case of the invention for a second embodiment of the means for attaching the writing instruments.

The usage of the support means in combination with the case of the invention, is illustrated in FIG. 12, in which it appears that the lid will remain "hanging" from the bottom of the base of the case, allowing easy and quick access for the user to any one of the articles on the interior of the container; the suction cups (500), (500') allow for the fixation of the section of the illustrated container (600) in a smooth vertical surface, such as a wall, board, or including a horizontal surface such as a table.

Once the use of the writing instruments has been concluded, they can be placed in their place inside the case, and it can be closed and eventually be removed from the wall or the surface to which it was temporarily fixed.

With reference now to FIGS. 8*a*, 8*b*, 9*a*, and 9*b*, they are schematically representing a detail of one of the preferred embodiment that has joint hinges (110), it corresponds to a cross cut along the line A-A as shown in FIG. 1.

Figure 9B:
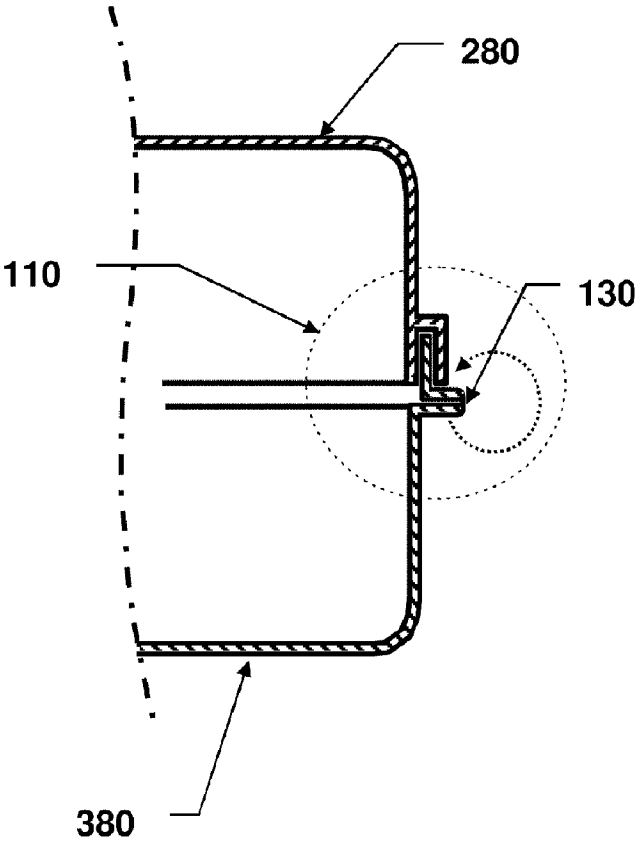
FIG. 9*b* is a partial cross-section view showing the details of the hinged element between the body and the lid of the case of the invention, in its closed position.
Figure 9A:
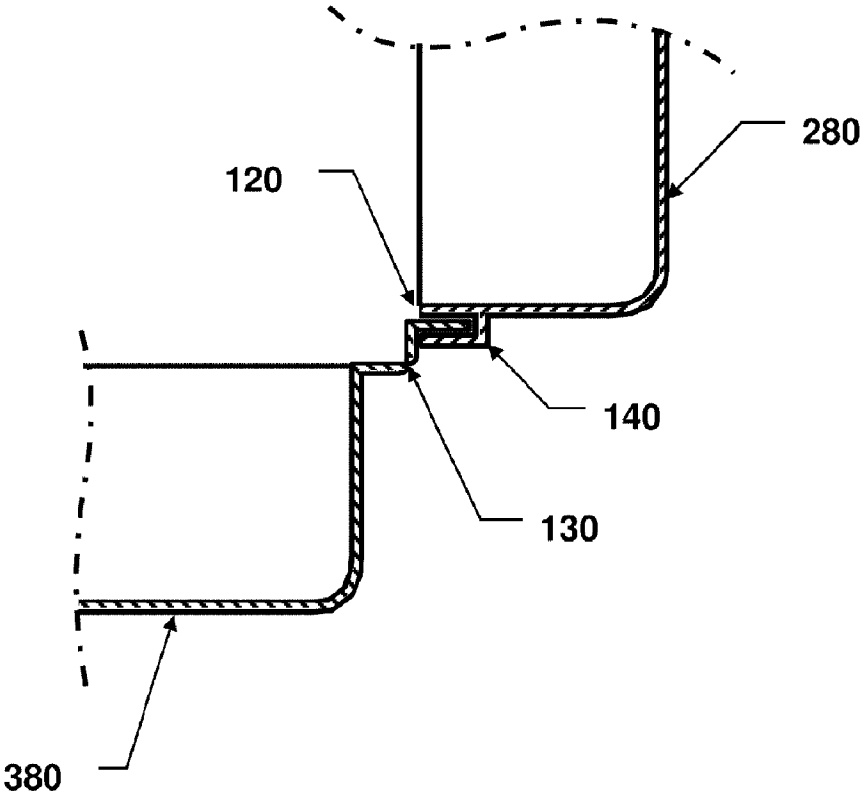
FIG. 9*a* is a partial cross-section view showing the details of the hinged element between the body and the lid of the case of the invention, in an open position.
Figure 10:
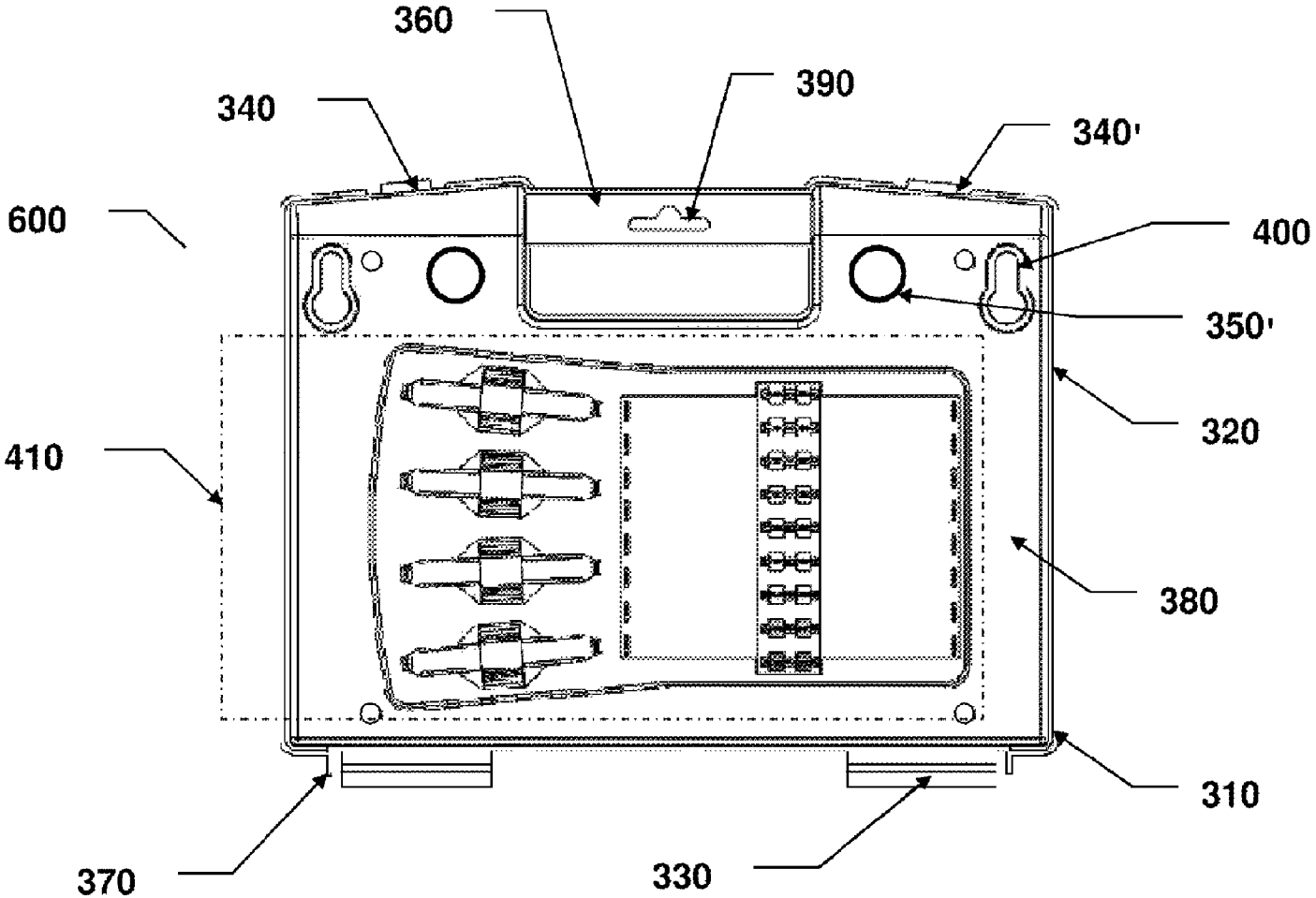
FIG. 10 is an interior view of the case's body with a first embodiment for the means of attaching the writing instruments.
Figure 11:
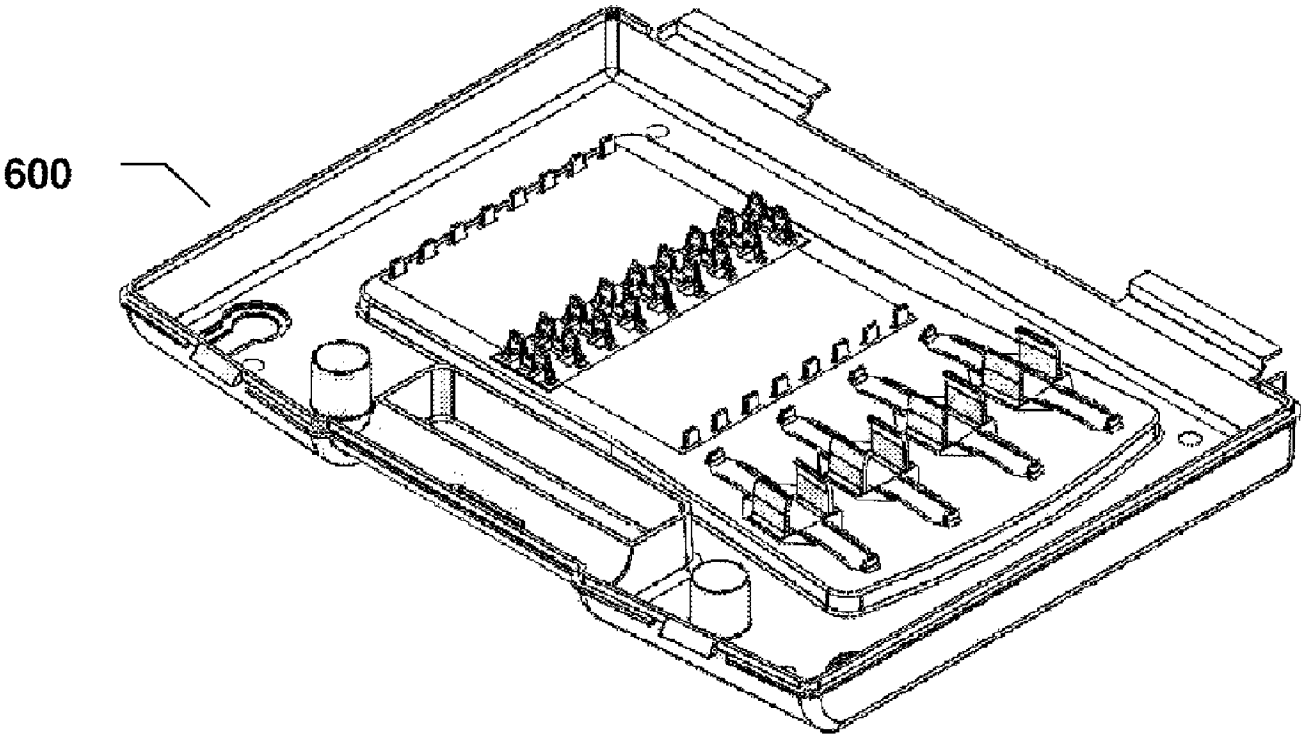
FIG. 11 is a simple perspective view of the body of the case of the invention for a first embodiment of the means of attaching the writing instruments.

The joint hinge (110) shown in the FIG. 9*b* is composed of two sections.

A female section designated by the number (140) associated with the lid (200) of the case (100) and integrally formed with it, that has the form of a groove or channel with a transversal "U" section, located close to the edge of the vertical peripheral wall (215) that surrounds the cover (280) of the lid (200), and A male section designated by numbers (330), (330') associated with the base (300) of the case (100) and integrally formed with it, being at the same time formed by a set element (150) that is a flat projection from the edge of the vertical peripheral wall (315) that surrounds and defines the cover (380) and a moving element with a profile shaped in a ninety degree angle "L" (120), joined all along an edge (130) over which the movement of the hinge can be realized, as is illustrated by the arrow in FIG. 9*b*. The free end of the movable element (120) is placed into the channel (140), being maintained in its place by means of pressure, an adhesive or other adequate means of fixation, to permit the hinged movement of the sections of the lid (200) and the base (300) of the case of the invention (100).

The configuration of the means of the hinge or of the joint hinge recently described, has the particularity to allow for the total extension of the lid in a way that the plane formed by the perimeter edge is aligned with the plane formed by the perimeter edge of the base, that is, they forms an angle of 180[deg.], allowing complete access to the contents of the case when it is completely open, as is the case when the case is attached to a smooth vertical surface as is illustrated in the FIG. 12.

Considering the previous description, it is evident for the person skilled in the art that some modifications to the basic configuration of the illustrated model could be necessary in order to satisfy particular requirements but it should be considered that these modifications will not take the invention described further than the scope of the following claims.

Examples of the modifications that are considered within the scope of the invention are presented in FIGS. 8, 9, 10, 13, and 14 in which the first 3 represent the first embodiment (600) of the invention in which a plurality of fasten means for writing instruments with a specific order has been included. FIGS. 13 and 14 illustrate a second embodiment (700) in which the case (420) offers a different order and quantity of fastener means for the writing instruments. It can be appreciated that the modification of the location, number and nature of said means of fixation do not affect the function or the utility of the article as it has been described and they obey mainly to the esthetic effect that is desired to grant to the case and the articles contained that are visible through the transparent or translucent lid. In any case, it is recommendable to consider to maintain a balanced distribution in the weight of the instruments, through the means of fixation, in order that the suction cups receive similar loads and can maintain the case in a secure place on a smooth surface.

We claim:

1. A case for storage and transportation of a plurality of writing instruments, shaped as a rectangular-prism with rounded-corners, comprising a base and a lid, said base and lid being attached by means of hinges located on one of the common large sides of said base and lid; a handle in the free large side; and co-operable means in the same side as the handle, for closing and maintain closed the case; wherein:

a. the base includes two holes with a skinny "8" shape located close to the upper corners to receive a couple of suction cups to attach the case to a flat and smooth surface such as a wall or board;

b. the hinges are formed by co-operable male and female protruding sections, the male section of the hinge with a "L" shaped profile protruding from the base, and the female section as channel shape to receive the male section, protruding from the lid;

c. both hinge sections integrally molded with base and lid respectively, and designed to permit that the upper edge of base and lid form a coplanar angle when the case is wide open;

d. the base of the case includes integrally formed fastening means to fasten a plurality of writing instruments in an easy to release way, and distributed to offer a balanced charge in the case; and e. the handle is made of two halves, each one formed integrally with lid and base, and the handle having a hole to permit the pass of exhibiting means through it.

* * * * *